US006020115A

United States Patent [19]

Orengo et al.

[11] Patent Number: 6,020,115

[45] Date of Patent: Feb. 1, 2000

[54] LIGHT-SENSITIVE SILVER HALIDE COLOR PHOTOGRAPHIC ELEMENTS CONTAINING 2-EQUIVALENT 5-PYRAZOLONE MAGENTA COUPLERS

[75] Inventors: Ferdinando Orengo, Altare; Luisa Tavella, Bergeggi; Antonio Poggi, Quiliano-Valleggia, all of Italy

[73] Assignee: Tulalip Consultoria Comercial Sociedade Unipessoal, Portugal

[21] Appl. No.: 09/102,846

[22] Filed: Jun. 23, 1998

[30] Foreign Application Priority Data

Jun. 30, 1997 [EP] European Pat. Off. ..... 97110640

[51] Int. Cl.[7] ..... G03C 1/08

[52] U.S. Cl. ..... 430/509; 430/506; 430/555; 430/544; 430/957

[58] Field of Search ..... 430/504, 506, 430/543, 555, 544, 957, 509

[56] References Cited

U.S. PATENT DOCUMENTS

| | | | |
|---|---|---|---|
| 4,571,378 | 2/1986 | Sauerteig et al. | 430/506 |
| 4,804,619 | 2/1989 | Yamada et al. | 430/506 |
| 4,963,465 | 10/1990 | Matejec et al. | 430/506 |
| 5,545,513 | 8/1996 | Edwards | 430/506 |
| 5,563,026 | 10/1996 | Singer | 430/506 |

FOREIGN PATENT DOCUMENTS

| | | |
|---|---|---|
| 0 631 181 A1 | 12/1994 | European Pat. Off. . |
| 0 747 761 A1 | 12/1996 | European Pat. Off. . |
| 195 43 200 A1 | 5/1997 | Germany . |

*Primary Examiner*—Geraldine Letscher

[57] ABSTRACT

Multilayer color photographic element having on a support base blue-, green- and red-sensitive silver halide emulsion layers respectively associated with non-diffusing yellow, magenta and cyan dye-forming couplers, wherein (a) the green-sensitive silver halide emulsion layer comprises three green-sensitive silver halide emulsion layers, respectively uppermost, intermediate and lowermost, sensitive to the same spectral region of visible light, in which the sensitivity of the three green-sensitive silver halide emulsion layers decreases in order from the uppermost silver halide emulsion layer to the lowermost silver halide emulsion layer, (b) each of the three green-sensitive silver halide emulsion layers contains an 1-phenyl-3-anilino-4-phenylthio-5-pyrazolone magenta dye-forming coupler, (c) the weight ratio of the coupler to silver halide (expressed as silver) in the highest sensitivity uppermost green-sensitive silver halide emulsion layer is higher than the weight ratio of the coupler to silver halide (expressed as silver) in the medium sensitivity intermediate green-sensitive silver halide emulsion layer, and (d) the highest sensitivity uppermost green-sensitive silver halide emulsion layer contains a DIR coupler.

The color photographic elements containing the aforesaid layer arrangement provide good speed-granularity relationship, good interimage effects, and less changes in the photographic properties such as decrease in color density and increase in fog when brought in contact with formaldehyde gas during storage prior to color development.

14 Claims, No Drawings

LIGHT-SENSITIVE SILVER HALIDE COLOR PHOTOGRAPHIC ELEMENTS CONTAINING 2-EQUIVALENT 5-PYRAZOLONE MAGENTA COUPLERS

FIELD OF THE INVENTION

The present invention relates to silver halide color photographic light-sensitive elements containing 2-equivalent 5-pyrazolone magenta dye-forming couplers and, more particularly, 2-equivalent 1-phenyl-3-anilino-4-phenylthio-5-pyrazolone magenta dye-forming couplers.

BACKGROUND OF THE INVENTION

It is well known that color photographic light-sensitive elements, using the subtractive process for color reproduction, comprise silver halide emulsion layers selectively sensitive to blue, green and red light and associated with yellow, magenta and cyan dye-forming couplers which form (upon reaction with an oxidized primary amine type color developing agent) the complementary color thereof. For example, an acylacetanilide type coupler is used to form a yellow color image; a 5-pyrazolone, pyrazolotriazole, cyanacetophenone or indazolone type coupler is used to form a magenta color image; and a phenol type, such as a phenol or naphthol, coupler is used to form a cyan color image.

Usually, the color photographic light-sensitive elements comprise non-diffusible couplers incorporated independently in each of the light-sensitive layers of the material (incorporated coupler materials). Therefore, a color photographic light-sensitive element usually comprises 1) a blue-sensitive silver halide emulsion layer (or layers) which contains a yellow dye-forming coupler and which is mainly sensitive to blue light (substantially to wavelengths less than about 500 nm); 2) a green-sensitive silver halide emulsion layer (or layers) which contains a magenta dye-forming coupler and which is mainly sensitive to green light (substantially to wavelengths of about 500 to 600 nm); and 3) a red-sensitive silver halide emulsion layer (or layers) which contains a cyan dye-forming coupler and which is mainly sensitive to red light (substantially to wavelengths longer than about 590 nm).

It is also known that 5-pyrazolones in which the 4-position of the pyrazolone ring is free, that is having only hydrogen substituents (4-equivalent magenta couplers), can be used as magenta couplers in color photographic elements to provide magenta dye images having useful properties. Examples of such couplers are the 4-equivalent 3-anilino-5-pyrazolone couplers described in, for example, U.S. Pat. Nos. 3,519,429, 3,907,571, 3,928,044, 3,935,015 and 4,199,361. However, 4-equivalent 5-pyrazolone couplers have a number of disadvantages, as they require four equivalents of silver to produce each molecule of dye, are sensitive to certain chemical vapors, for example formaldehyde, and have poor dye light and dye dark stability. These drawbacks can be overcome by using so-called 2-equivalent 5-pyrazolone magenta couplers in which a substituent is introduced into the coupling position (4-position) of the coupler and eliminated as a leaving group (coupling-off group or splitting-off groups) during the color development process, thus requiring only two equivalent of silver in order to produce each molecule of dye.

Among coupling-off groups known in this connection are the arylthio groups described, for example, in U.S. Pat. Nos. 3,227,554, 3,701,783, 3,935,015, 4,351,897, 4,413,054, 4,556,630, 4,584,266, 4,740,438, 4,853,319, 4,876,182, 4,900,657, 4,929,540, 4,942,116, 5,250,407, 5,262,292, and 5,256,528; WO 88/04795, 92/18902, and 93/02393; EP 341,204, and GB 1,494,777.

The silver halide emulsions used in the past for such photographic elements were the so-called mixed emulsions, that is, emulsions comprising a combination of a more sensitive emulsion (containing coarse silver halide grains) and a less sensitive emulsion (containing fine silver halide grains) whereby a straight density-log exposure curve could be obtained for each blue-, green- and red-sensitive layer.

Since granularity of the dye image in color photographic elements depends mainly upon the size of the silver halide grains employed, attempts to increase the sensitivity of the color photographic material by increasing the size of the silver halide grains (sensitivity of silver halide grains generally is proportional to the size of the silver halide grains) caused a coarsening of the granularity of the dye image.

As a method for improving sensitivity, a technique has been known in which the regular layer sequence of having respective red-sensitive, green-sensitive and blue-sensitive silver halide emulsion layers is provided by subdividing a part or whole of each of the emulsion layers into higher and lower sensitivity emulsion layers, each subdivided layer containing a color coupler forming substantially the same hue as the other subdivided layer and wherein these layers are coated adjacent to each other.

For example, GB 818,687 describes a method for increasing sensitivity in multilayer color photographic elements in which the emulsion layer which is applied closest to the support consists of two partial layers sensitized to the same region of the spectrum, the lower layer consisting of a less sensitive silver halide emulsion layer and the upper layer consisting of a more sensitive silver halide emulsion, both partial layers containing color-forming couplers in the same concentration. An element of this type has, however, the disadvantage that the increase in sensitivity is accompanied by an increase of granularity.

To overcome this disadvantage and lower the granularity of color images, GB 923,045 describes a method for increasing the sensitivity of a color photographic element without coarsening the granularity of the dye image by providing an uppermost more sensitive emulsion layer and a lowermost less sensitive emulsion layer, both layers being sensitive to the same region of the visible spectrum and each containing non-diffusing color couplers, with the maximum color density of the more sensitive emulsion layer being adjusted to be lower than that of the less sensitive emulsion layer, in particular being lower in an amount from 0.20 to 0.60.

U.S. Pat. No. 3,516,831 describes a process for improving the sharpness of the color image, according to which two layers which are sensitized to the same spectral region of the spectrum contain different couplers, the more sensitive emulsion layer containing 4-equivalent couplers and the less sensitive emulsion layer 2-equivalent couplers.

Both processes described in GB 923,045 and U.S. Pat. No. 3,516,831 have numerous disadvantages, for example, a worsening of granularity in high-sensitivity photo-graphic elements. A process for improving granularity is described in U.S. Pat. No. 3,726,681 wherein granularity of high-sensitivity photographic elements is improved by using a coupler having a fast coupling reaction rate in a more sensitive silver halide emulsion layer and a coupler having a slow coupling reaction rate in a less sensitive silver halide emulsion layer. Since, however, sharpness is not sufficiently improved, EP 107,112 describes a color photographic element in which at least one of the silver halide emulsion layers is composed of two silver halide emulsion layers sensitive to the same color, the more sensitive layer containing a high reaction rate coupler, and the less sensitive silver halide emulsion layer containing a low reaction rate coupler in a range of 1/1.3 to 1/15 of that of the high reaction rate coupler and a diffusible DIR (Development Inhibitor Releasing) coupler. The purpose of DIR couplers is to help in reducing graininess and improve sharpness of the image due to intralayer or intraimage effects (that is in the same layers or the same dye image) and improve color reproduction due to interlayer or interimage effects (that is effect between different layers or different dye images).

Recently, the picture size of photographic films has been reduced to miniaturize photo cameras, and silver halide grains have become coarser to increase sensitivity of photographic elements. Therefore, the degrading tendency of the granularity has been increased, even if the aforesaid double silver halide emulsion layer system is used.

U.S. Pat. No. 3,843,369 describes a method for further increasing the sensitivity of a color photographic element by providing three emulsion layers sensitive to the same spectral region of visible light and comprising image forming couplers, the uppermost silver halide emulsion layer having the highest light sensitivity and the lowermost silver halide emulsion layer having the lowest light sensitivity, the uppermost and the intermediate layer each having a maximum color density of 0.6 or less obtained by increasing the stoichiometrical molar ratio of the silver halide to the coupler up to about from 20 to 120.

U.S. Pat. No. 4,145,219 describes high speed and low granularity multilayer color photographic elements comprising red-sensitive, green-sensitive and blue-sensitive silver halide emulsion layers containing image forming couplers, wherein at least one of the silver halide emulsion layers comprises an upper unit silver halide emulsion layer, a middle unit silver halide emulsion layer and a lower unit silver halide emulsion layer, with each of the three unit layers being sensitive to visible light in the same spectral wavelength range, with sensitivity of the unit layers decreasing towards the lower unit layer, and with the middle unit layer containing a DIR coupler. In the unit layers, the amount of couplers in the upper unit layer is reduced so that the molar ratio of the silver halide to the coupler is 20:1 to 150:1, by which the maximum color density of the image becomes 0.6 to 0.1, while the molar ratios of the silver halide to the coupler in the middle unit layer and that in the lower unit layer are 10:1 to 100:1 and 2:1 to 5:1, respectively.

U.S. Pat. No. 4,564,587 discloses a light-sensitive silver halide color photographic material wherein at least one light-sensitive layer is constituted of a plurality of silver halide emulsion layers having the same color sensitiveness but being different in sensitivities and containing dye image-forming couplers, wherein the plurality of layers is provided by coating in the order from the support side a low sensitivity layer, a medium sensitivity layer and a high sensitivity layer, the density of coupler in the medium sensitivity layer is 10 to 60% of the coupler density in the low sensitivity layer, and the maximum color density in the medium sensitivity layer is between 0.6 and 1.2.

U.S. Pat. No. 4,582,780 describes a method for increasing sensitivity and improving adjacency effects by providing three emulsion layers sensitive to the same spectral region of visible light, the uppermost silver halide emulsion layer having the highest light sensitivity and the lowermost silver halide emulsion layer having the lowest light sensitivity, wherein the maximum color density of the uppermost silver halide emulsion layer, after color development, is lower than 0.60 and the maximum color densities of both the intermediate and the lowermost silver halide emulsion layers, after color development, are each higher than 0.60.

EP 583,020 discloses a technique for improving granularity by providing a multilayer color photographic element comprising a plurality of blue, green and three red sensitive silver halide emulsion layers, the layers being arranged on the support in the sequence: a red least sensitive layer, a green least sensitive layer, a red mid-sensitive layer, a red most sensitive layer, a green most sensitive layer, a blue most sensitive layer, and a blue least sensitive layer.

EP 608,464 discloses a technique for enhancing the speed-granularity relationship of dye images by providing multicolor photographic elements containing blue, green and red sensitive layer units wherein at least one layer unit contains three superimposed silver halide emulsion layers of different sensitivity comprising silver bromoiodide tabular grains of different iodide content.

Generally, the multilayer color photographic elements comprising three silver halide emulsion layers sensitive to the same spectral region of the visible light of different sensitivity have in the highest sensitivity uppermost layer a weight ratio of the coupler to the silver halide (expressed as silver) which is lower than or equal to that of the medium sensitivity intermediate layer and much lower than that of the lowest sensitivity lowermost layer. As known in the art, the highest sensitivity uppermost layer is a coupler "starved" layer, that is a layer in which there is much less dye-forming coupler than is theoretically capable of reacting with all the oxidized developing agent generated at maximum exposure.

As hereinbefore described, 2-equivalent 5-pyrazolone magenta couplers having an arylthio group attached to the 4-position of the pyrazolone ring have a number of advantages compared to 4-equivalent 5-pyrazolone magenta couplers in which the 4-position of the pyrazolone ring is free (that is having only hydrogen atoms). For example, 2-equivalent 5-pyrazolone couplers require only two equivalent of silver to produce each molecule of dye, are less sensitive to certain chemical vapors, for example formaldehyde, and have high dye light and dye dark stability. However, 2-equivalent 5-pyrazolone magenta couplers have the disadvantage that they may cause worsening of granularity and interimage effects when used in all the three silver halide emulsion layers sensitive to the green spectral region of the visible spectrum.

SUMMARY OF THE INVENTION

The present invention relates to a multilayer color photographic element having on a support base blue-, green- and red-sensitive silver halide emulsion layers respectively associated with non-diffusing yellow, magenta and cyan dye-forming couplers, wherein (a) the green-sensitive silver halide emulsion layer comprises three green-sensitive silver halide emulsion layers, respectively uppermost, intermediate and lowermost, sensitive to the same spectral region of visible light, in which the sensitivity of the three green-sensitive silver halide emulsion layers decreases in order from the uppermost silver halide emulsion layer to the lowermost silver halide emulsion layer, (b) each of the three green-sensitive silver halide emulsion layers contains an 1-phenyl-3-anilino-4-phenylthio-5-pyrazolone magenta dye-forming coupler, (c) the weight ratio of the coupler to silver halide (expressed as silver) in the highest sensitivity uppermost green-sensitive silver halide emulsion layer is higher than the weight ratio of the coupler to silver halide (expressed as silver) in the medium sensitivity intermediate green-sensitive silver halide emulsion layer, and (d) the highest sensitivity uppermost green-sensitive silver halide emulsion layer contains a DIR coupler.

The color photographic elements containing the aforesaid layer arrangement provide good speed-granularity relationship, good interimage effects, and less changes in the photographic properties such as decrease in color density and increase in fog when brought in contact with formaldehyde gas during storage prior to color development.

DETAILED DESCRIPTION OF THE INVENTION 1-phenyl-3-anilino-4-phenylthio-5-pyrazolone magenta couplers for use in the present invention may be represented by the following formula (I)

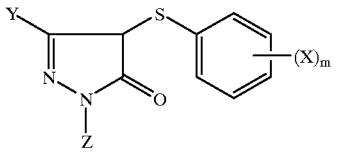

wherein Z represents a phenyl group substituted with one or more substituents selected from halogen atoms, alkyl groups, alkoxy groups, alkoxycarbonyl groups, or cyano groups, Y represents an anilino group, X represents hydrogen, alkyl, alkoxy, halogen, aryl, aryloxy, acylamino, sulfonamido, sulfamoyl, carbamoyl, arylsulfonyl, aryloxycarbonyl, alkoxycarbonyl, alkoxysulfonyl, aryloxysulfonyl, alkylureido, arylureido, nitro, cyano, hydroxyl or carboxy group, m represents an integer of from 1 to 5 and X may be the same or different when m is 2 or more.

In particular, preferred 1-phenyl-3-anilino-4-phenylthio-5-pyrazolone magenta coupler for use in this invention are those represented by the formula (II):

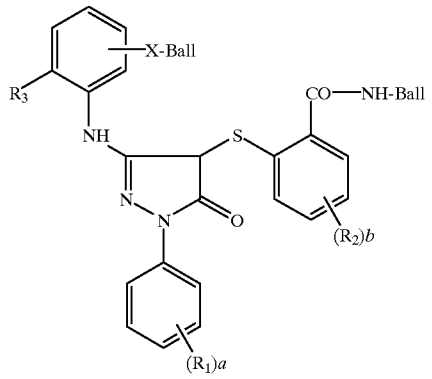

wherein a represents an integer from 0 to 3, b represents an integer from 0 to 2, $R_1$ and $R_2$ are each individually hydrogen, alkyl, alkoxy, halogen, aryl, aryloxy, acylamino, sulfonamido, sulfamoyl, carbamoyl, arylsulfonyl, aryloxycarbonyl, alkoxycarbonyl, alkoxysulfonyl, aryloxysulfonyl, alkylureido, arylureido, nitro, cyano, hydroxyl or carboxy group, $R_3$ is halogen atom, alkyl group or aryl group, X is a direct link or a linking group, Ball is a ballasting group of such size and configuration as to render a group to which is attached non-diffusible in photographic coatings, and the sum of the sigma values of $R_1$, $R_3$ and X-Ball is less than 1.3.

In the above formula, examples of $R_1$ and $R_2$ include hydrogen; alkyl group, including straight or branched chain alkyl group, such as alkyl group containing 1 to 8 carbon atoms, for example methyl, trifluoromethyl, ethyl, butyl, and octyl; alkoxy group, such as an alkoxy group having 1 to 8 carbon atoms, for example methoxy, ethoxy, propoxy, 2-methoxyethoxy, and 2-ethylhexyloxy; halogen, such as chlorine, bromine, and fluorine; aryl group, such as phenyl, naphthyl, and 4-tolyl; aryloxy group, such as phenoxy, p-methoxyphenoxy, p-methylphenoxy, naphthyloxy, and tolyloxy; acylamino group, such as acetamido, benzamido, butyramido, and t-butylcarbonamido; sulfonamido group, such as methylsulfonamido, benzenesulfonamido, and p-toluylsulfonamido; sulfamoyl group, such as N-methylsulfomyl, N,N-diethylsulfamoyl, and N,N-dimethylsulfamoyl; carbamoyl group, such as N-methylcarbamoyl, and N,N-dimethylcarbamoyl; arylsulfonyl, such as tolylsulfonyl; aryloxycarbonyl group, such as phenoxycarbonyl; alkoxycarbonyl group, such as alkoxycarbonyl group containing 2 to 10 carbon atoms, for example methoxycarbonyl, ethoxycarbonyl, and benzyloxycarbonyl; alkoxysulfonyl group, such as alkoxysulfonyl group containing 2 to 10 carbon atoms, for example methoxysulfonyl, octyloxysulfonyl, and 2-ethylhexylsulfonyl; aryloxysulfonyl group, such as phenoxysulfonyl; alkylureido group, such as N-methylureido, N,N-dimethylureido, and N,N-dibutylureido; arylureido group, such as phenylureido; nitro, cyano, hydroxyl and carboxy group.

Examples of $R_3$ include halogen, such as chlorine, bromine, and fluorine; alkyl group, including straight or branched chain alkyl group, such as alkyl group containing 1 to 8 carbon atoms, for example methyl, trifluoromethyl, ethyl, butyl, and octyl; aryl group, such as phenyl, naphthyl, and 4-tolyl.

"Ball" is a ballasting group, i.e., an organic group of such size and configuration as to render a group to which is attached non-diffusible from the layer in which is coated in a photographic element. Said ballasting group includes an organic hydrophobic residue having 8 to 32 carbon atoms bonded to the coupler either directly or through a divalent linking group, such as an alkylene, imino, ether, thioether, carbonamido, sulfonamido, ureido, ester, imido, carbamoyl, and sulfamoyl group. Specific examples of suitable ballasting groups include alkyl groups (linear, branched, or cyclic), alkenyl groups, alkoxy groups, alkylaryl groups, alkylaryloxy groups, acylamidoalkyl groups, alkoxyalkyl groups, alkoxyaryl groups, alkyl groups substituted with an aryl group or a heterocyclic group, aryl groups substituted with an aryloxyalkoxycarbonyl group, and residues containing both an alkenyl or alkenyl long-chain aliphatic group and a carboxy or sulfo water-soluble group, as described, for example, in U.S. Pat. Nos. 3,337,344, 3,418,129, 3,892,572, 4,138,258, and 4,451,559, and in GB 1,494,777.

When the term "group" or "residue" is used in this invention to describe a chemical compound or substituent, the described chemical material includes the basic group or residue and that group or residue with conventional substitution. Where the term "moiety" is used to describe a chemical compound or substituent, only the unsubstituted chemical material is intended to be included. For example, "alkyl group" includes not only such alkyl moiety as methyl, ethyl, butyl, octyl, stearyl, etc., but also moieties bearing substituent groups such as halogen, cyano, hydroxyl, nitro, amino, carboxylate, etc. On the other hand, "alkyl moiety" includes only methyl, ethyl, stearyl, cyclohexyl, etc.

In the present invention, the sum of sigma values of substituents on the 1-phenyl and 3-anilino groups, such as $R_1$, $R_3$ and -X-Ball is less than 1.3. The values of sigma constants can be easily found in the published literature (see, for example, "The Chemists° Companion", A. J. Gordon and R. A. Ford, John Wiley & Sons, New York, 1972, "Progress in Physical Organic Chemistry", V. 13, R. W. Taft, John Wiley & Sons, New York, "Substituents Constants for Correlation Analysis in Chemistry and Biology", C. Hansch and A. J. Leo, John Wiley & Sons, New York, 1979, and "Comprehensive Medicinal Chemistry", A. J. Leo, Pergamon Press, New York, V. 4, 1990), or can be calculated using the Medchem program (see "Comprehensive Medicinal Chemistry", A. J. Leo, Pergamon Press, New York, V. 4, 1990). Generally, sigma values increase with increasing electron withdrawing power of the substituent, with hydrogen=zero. For sigma values, only the atoms close to the phenyl ring have an electron withdrawing effect and remote atoms have no effect. Examples of sigma values for chemical groups or atoms are as follows: alkyl group=−0.17, chlorine atom=0.23, alkoxycarbonyl group=0.45, acylamino group=0.21, sulfamoyl group=0.57, alkylsulfonyl group=0.78, and carbamoyl=0.36.

Among the couplers described above, a preferred embodiment is represented by the above formula wherein the groups $R_1$ are chlorine atoms, a is 3, and the chlorine atoms are attached to the carbon atoms in position 2, 4 and 6 with respect to the carbon atom attached to the nitrogen atom.

A particularly preferred embodiment is represented by the above formula wherein the group $R_3$ is a chlorine atom.

Specific examples of 2-equivalent 1-phenyl-3-anilino-4-phenylthio-5-pyrazolone magenta couplers for use in the present invention are illustrated below, but the present invention should not be construed as being limited thereto.

I-1

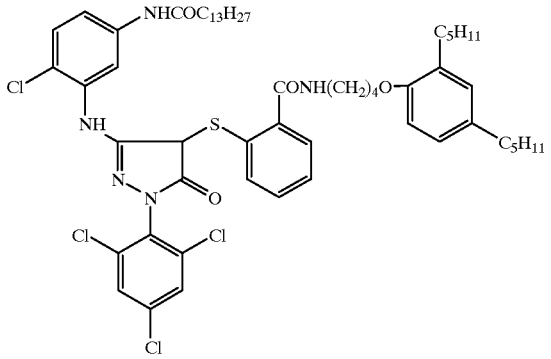

I-2

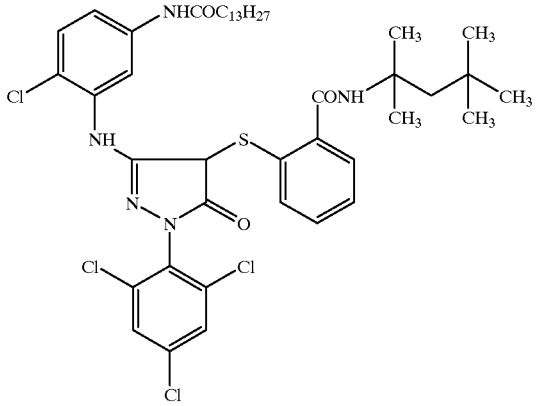

I-3

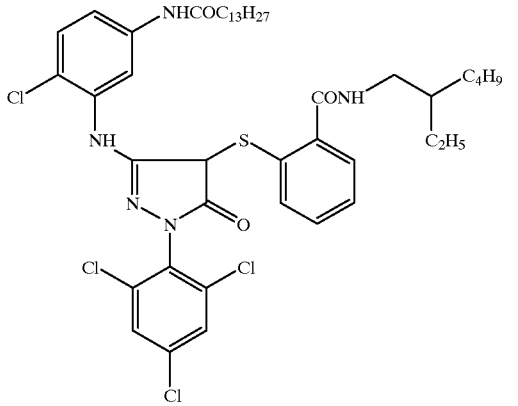

I-4
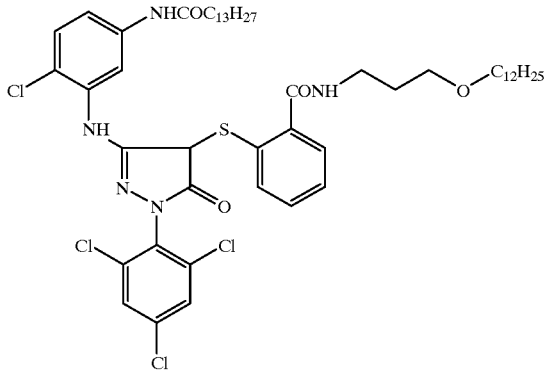
I-5
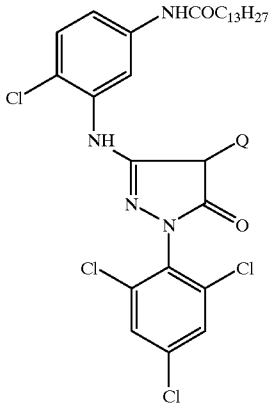
I-6
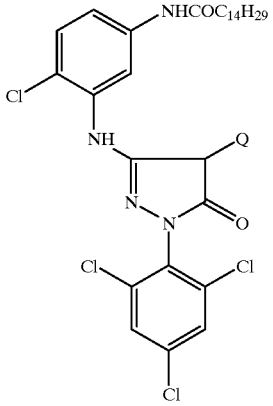
I-7
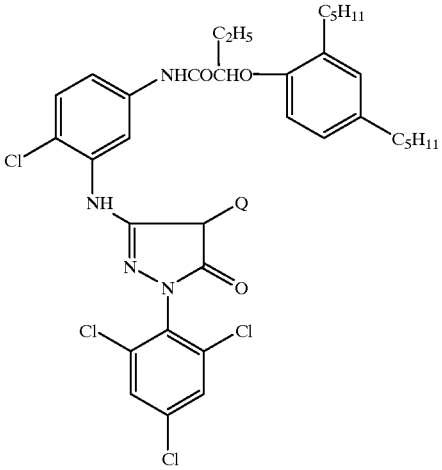
I-8
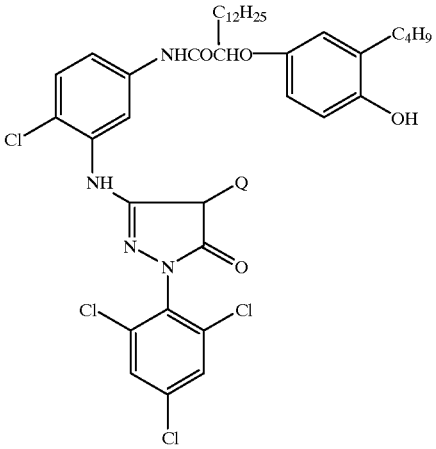
I-9
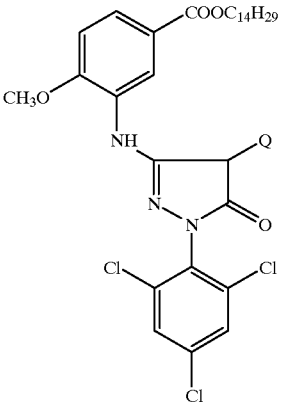

wherein Q represents a coupling-off group according to the invention.

Illustrative coupling-off groups Q are as follows:

Q-1

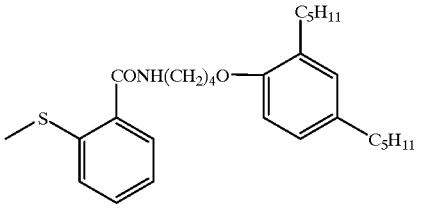

Q-2

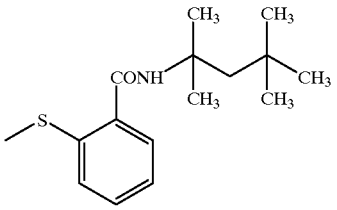

Q-3

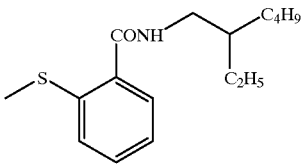

Q-4

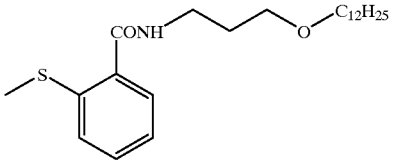

Q-5

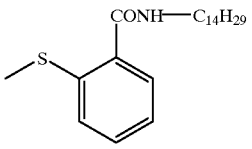

Q-6

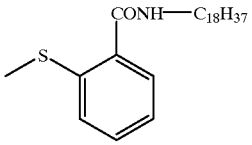

Q-7

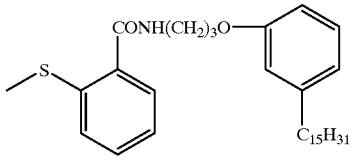

As described above, the present invention relates to a multilayer color photographic element having on a support base blue-, green- and red-sensitive silver halide emulsion layers respectively associated with non-diffusing yellow, magenta and cyan dye-forming couplers, wherein (a) the green-sensitive silver halide emulsion layer comprises three green-sensitive silver halide emulsion layers, respectively uppermost, intermediate and lowermost, sensitive to the same spectral region of visible light, in which the sensitivity of the three green-sensitive silver halide emulsion layers decreases in order from the uppermost silver halide emulsion layer to the lowermost silver halide emulsion layer, (b) each of the three green-sensitive silver halide emulsion layers contains an 1-phenyl-3-anilino-4-phenylthio-5-pyrazolone magenta dye-forming coupler, (c) the weight ratio of the coupler to silver halide (expressed as silver) in the highest sensitivity uppermost green-sensitive silver halide emulsion layer is higher than the weight ratio of the coupler to silver halide (expressed as silver) in the medium sensitivity intermediate green-sensitive silver halide emulsion layer, and (d) the highest sensitivity uppermost green-sensitive silver halide emulsion layer contains a DIR coupler.

In this invention, "sensitive to the same spectral region of visible light" means that any of low sensitivity silver halide emulsion layer, medium sensitivity silver halide emulsion layer and high sensitivity silver halide emulsion layer has a light-sensitivity to any of the wavelength region of the green color region. Even when the light-sensitivity may differ between the layers slightly with respect to a certain wavelength region, such light-sensitive layers are deemed to be substantially the same in color sensitivity. As used herein, the terms "uppermost", "intermediate" and "lowermost" are with respect to incident light of exposure and support base, with uppermost being closest to this incident light of exposure and farthest from the support base.

As far as the sensitivity differences between the three green-sensitive silver halide emulsion layers is concerned, these can be chosen as known in the art according to the characteristic D-logE (Density-logExposure, wherein E is the exposure amount in lux-seconds) curve to be obtained. In color camera film, a D-logE curve is desired which must be straight, even (without humps), and having a wide exposure latitude. This is accomplished by using coarse grain size silver halide emulsions in the uppermost emulsion layer (that gives the threshold sensitivity to the element), and respectively mean and fine grain size silver halide emulsions in the intermediate and lowermost emulsion layers. In general, it is preferred to have a difference in light-sensitivity of 0.15 to 1.3 logE between the high sensitivity uppermost emulsion layer and the medium sensitivity intermediate emulsion layer, a sensitivity difference between the medium sensitivity intermediate emulsion layer and the lower sensitive lowermost emulsion layer of 0.1 to 0.7 logE, and a sensitivity difference between the high sensitivity uppermost emulsion layer and the low sensitivity lowermost emulsion layer of 0.3 to 1.5 logE.

To obtain the benefits of this invention, the weight ratio of the 1-phenyl-3-anilino-4-phenylthio-5-pyrazolone magenta dye-forming coupler to silver halide (expressed as silver) in the highest sensitivity uppermost green-sensitive silver halide emulsion layer is higher than the above ratio in the medium sensitivity intermediate green-sensitive silver halide emulsion layer. The coupler/silver ratio in the uppermost layer is required to be 10 to 150%, preferably 20 to 100%, higher than the coupler/silver ratio in the intermediate layer. Generally, the amount of silver used in each layer is about 0.2 to 2.0 g/m$^2$, preferably about 0.4 to 1.5 g/m$^2$. Since the uppermost and the intermediate layers each contains less 1-phenyl-3-anilino-4-phenylthio-5-pyrazolone magenta dye-forming coupler than is theoretically capable of reacting with all of the oxidized developing agent generated at maximum exposure during development following exposure, the maximum color density, after development, in the above high sensitivity uppermost emulsion layer is higher than the above density, after development, in the medium sensitivity intermediate emulsion layer. The maximum color density of each emulsion layer can be adjusted to the desired values according to this invention by lowering or increasing the quantity of 1-phenyl-3-anilino-4-phenylthio-5-pyrazolone magenta dye-forming coupler in the considered layer. Of course, the maximum color density of the multilayer color photographic element will vary depending upon the desired "effective" curve which, according to the mixing law, is formed by accumulating the densities of all of the three emulsions. In case of color negative camera film, such effective curve generally has a maximum color density in the range of 2.0 to 3.0, preferably in the range of 2.2 to 2.8. To the purposes of the present invention, the color density of a single green-sensitive emulsion layer is given with respect to the density provided by the three green-sensitive emulsion layers contributing to form the same magenta color upon exposure and development of the photographic element containing them and is calculated from the measured total magenta color density multiplied by the percent quantity of the 1-phenyl-3-anilino-4-phenylthio-5-pyrazolone magenta dye-forming coupler with respect to the total quantity of the coupler in such three green-sensitive emulsion layers. Based on the above, it is preferred that the maximum color density in the above green-sensitive high sensitivity uppermost emulsion layer according to this invention is higher than 0.6, preferably higher than 0.7, and the maximum color density in the above green-sensitive medium sensitivity intermediate emulsion layer according to this invention is lower than 0.6, preferably lower than 0.5. Couplers other than magenta dye-forming couplers can be present in the green-sensitive emulsion layers and such couplers can include, for example, timed DIR couplers and color correcting couplers. These other couplers are typically used at concentrations substantially lower than the 1-phenyl-3-anilino-4-phenylthio-5-pyrazolone magenta dye-forming coupler and can produce magenta dye typically not more than 5% of the total density of the green-sensitive layers.

According to this invention, in addition to the improvement concerning the interimage effects brought about by making higher the coupler/silver ratio in the highest sensitivity uppermost green-sensitive emulsion layer, an improved effect can be obtained concerning granularity by provision of a DIR coupler in the highest sensitivity uppermost green-sensitive emulsion layer. The amount of DIR coupler is 2 to 10% by weight and preferably 5 to 8% by weight based on the amount of 1-phenyl-3-anilino-4-phenylthio-5-pyrazolone magenta dye-forming coupler.

Development inhibitor releasing (DIR) couplers for use in this invention include those couplers which can react with the oxidized product of a developing agent to release a development inhibitor. Any DIR coupler known in the art can be used in the present invention. Typical DIR couplers are described in, for example, U.S. Pat. Nos. 3,148,062; 3,227,554; 3,384,657; 3,615,506; 3,617,291 and 3,733,201; DE 2,414,006 and 2,527,652; JP 159,263/75; 34,615/76; 30,591/75; 159,255/75; 7,770/76; 70,592/75 and 146,570/75; and GB 1,450,479. Such DIR couplers preferably do not contain a group that times or delays the release upon oxidative coupling of the development inhibitor moiety. Specifically, the DIR couplers are represented by the formula COUP-Z wherein COUP represents a coupler moiety capable of releasing the Z group and forming a dye through coupling with the oxidized product of a color developing agent. COUP can be any coupler moiety, such as, for example, a cyan, magenta or yellow coupler known in the art. COUP can be ballasted with a ballast group known in the art. COUP can also be monomeric, or it can form part of a dimeric, oligomeric or polymeric coupler, in which case more than one Z group can be contained in the DIR coupler. Z represents the releasable development inhibitor group and can be any development inhibitor group known in the photographic art. Examples include those described in, for example, the documents hereinbefore mentioned for DIR couplers. Illustrative Z groups include: mercaptotetrazoles, mercaptobenzothiazoles, mercaptobenzimidazoles, mercaptobenzoxazoles, mercaptooxadiazoles, mercaptothiadiazoles, benzotriazoles, benzodiazoles, mercaptotriazoles, 1,2,4-triazoles, tetrazoles, and imidazoles. Particularly preferred development inhibitor groups are described in, for example, U.S. Pat. Nos. 4,477,563 and 4,782,012.

Preferably, the DIR couplers used in this invention have the following formula (III):

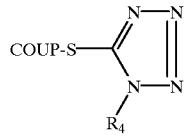

wherein COUP is as hereinbefore defined and $R_4$ represents an alkyl group, preferably an alkyl group having 1 to 4 carbon atoms, or a phenyl group. Example of the above alkyl group are methyl, ethyl, i-propyl, n-propyl, n-butyl, sec-butyl, and tert-butyl. The above alkyl group and phenyl group may further have substituents, preferably such as methoxy, ethoxy, hydroxy, and carboxy.

Specific examples of DIR couplers useful in this invention are illustrated below, but the invention is not limited thereto.

III:1

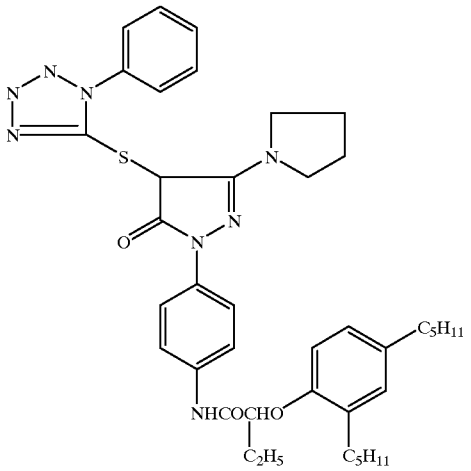
III-3:
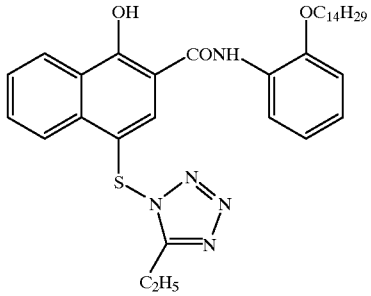
III-2:
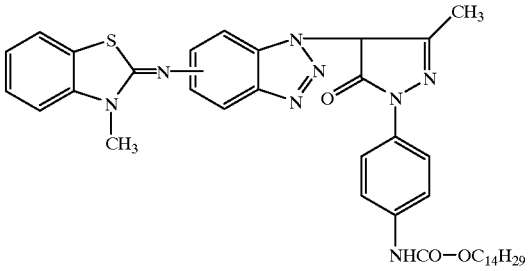
III-4:
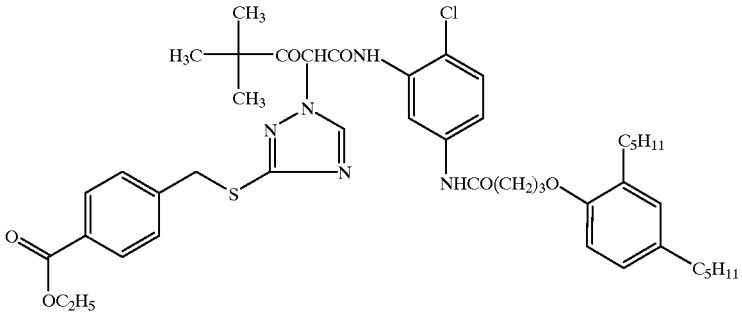
III-5:
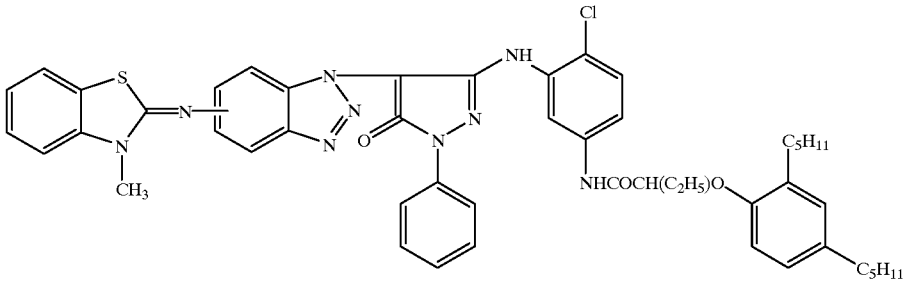

III-6:

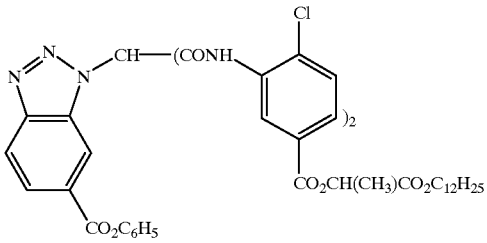

III-7:

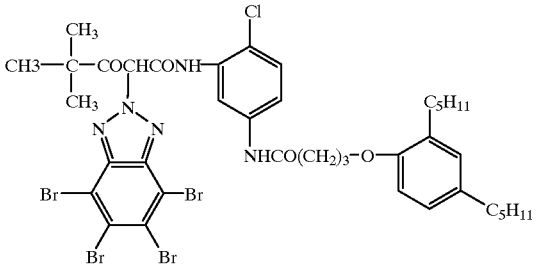

III-8:

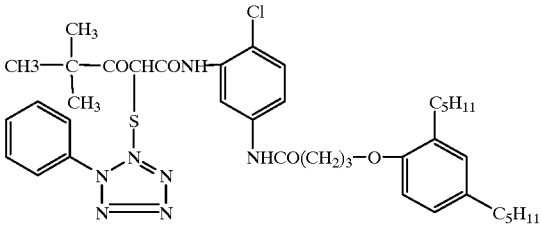

III-9:

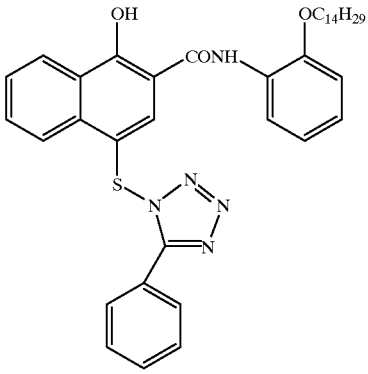

III-10:

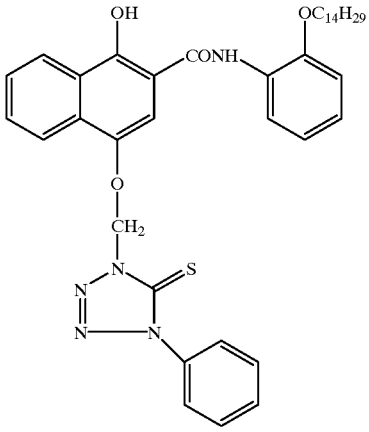

The multilayer silver halide color photographic elements of the present invention can be conventional photographic elements containing a silver halide as a light-sensitive substance.

The silver halides used in the multilayer color photographic elements of this invention may be a fine dispersion (emulsion) of silver chloride, silver bromide, silver chloro-bromide, silver iodo-bromide and silver chloro-iodo-bromide grains in a hydrophilic binder. Preferred silver halides are silver iodo-bromide or silver iodo-bromo-chloride containing 1 to 20% mole silver iodide. In silver iodo-bromide emulsions or silver iodo-bromo-chloride, the iodide can be uniformly distributed among the emulsion grains, or iodide level can varied among the grains. The silver halides can have a uniform grain size or a broad grain size distribution. The silver halide grains may be regular grains having a regular crystal structure such as cubic, octahedral, and tetradecahedral, or the spherical or irregular crystal structure, or those having crystal defects such as twin plane, or those having a tabular form, or the combination thereof.

The term "cubic grains" according to the present invention is intended to include substantially cubic grains, that is grains which are regular cubic grains bounded by crystallographic faces (100), or which may have rounded edges and/or vertices or small faces (111), or may even be nearly spherical when prepared in the presence of soluble iodides or strong ripening agents, such as ammonia. Particularly good results are obtained with silver halide grains having average grain sizes in the range from 0.2 to 3 $\mu$m, more preferably from 0.4 to 1.5 $\mu$m. Preparation of silver halide emulsions comprising cubic silver iodobromide grains is described, for example, in Research Disclosure, Vol. 184, Item 18431, Vol. 176, Item 17644 and Vol. 308, Item 308119.

Other silver halide emulsions for use in this invention are those which employ one or more light-sensitive tabular grain emulsions. The tabular silver halide grains contained in the emulsion of this invention have an average diameter:thickness ratio (often referred to in the art as aspect ratio) of at least 2:1, preferably 2:1 to 20:1, more preferably 3:1 to 14:1, and most preferably 3:1 to 8:1. Average diameters of the tabular silver halide grains suitable for use in this invention range from about 0.3 μm to about 5 μm, preferably 0.5 μm to 3 μm, more preferably 0.8 μm to 1.5 μm. The tabular silver halide grains suitable for use in this invention have a thickness of less than 0.4 μm, preferably less than 0.3 μm and more preferably less than 0.2 μm.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition, the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 2:1. Each of the above proportions, "15%", "25%" and "50%" means the proportion of the total projected area of the tabular grains having a diameter:thickness ratio of at least 2:1 and a thickness lower than 0.4 μm, as compared to the projected area of all of the silver halide grains in the layer.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, and 3,979,213, Research Disclosure, Dec. 1989, Item 308119 "Photographic Silver Halide Emulsions, Preparations, Addenda, Processing and Systems", and Research Disclosure, Sept. 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, and 1,302,405, U.S. Pat. Nos. 3,801,326, 4,046,376, 3,790,386, 3,897,935, 4,147,551, and 4,171,224.

The single jet method in which a silver nitrate solution is added in a halide and gelatin solution has been long used for manufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

In preparing the silver halide emulsions for use in the present invention, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc., a synthetic resin, such as polyvinyl alcohol, polyvinylpyrrolidone, polyacrylamide, etc. Other hydrophilic materials useful known in the art are described, for example, in Research Disclosure, Vol. 308, Item 308119, Section IX.

The silver halide grain emulsion for use in the present invention can be chemically sensitized using sensitizing agents known in the art. Sulfur containing compounds, gold and noble metal compounds, and polyoxyalkylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section III, 1989.

The silver halide emulsion for use in the present invention can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic heterocyclic nucleus of the cyanine-dye type and an acidic nucleus, which can be derived from barbituric acid, 2-thiobarbituric acid, rhodanine, hydantoin, 2-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkataraman, The chemistry of Synthetic Dyes, Academic Press, New York, 1971, Chapter V, James, The Theory of the Photographic Process, 4th Ed., Macmillan, !977, Chapter 8, F. M. Hamer, Cyanine Dyes and Related Compounds, John Wiley and Sons, 1964, and in Research Disclosure 308119, Section III, 1989.

The silver halide emulsions for use in this invention can contain optical brighteners, antifogging agents and stabilizers, filtering and antihalo dyes, hardeners, coating aids, plasticizers and lubricants and other auxiliary substances, as for instance described in Research Disclosure 17643, Sections V, VI, VII, X, XI and XII, 1978, and in Research Disclosure 308119, Sections V, VI, VIII, X, XI, and XII, 1989.

The silver halide emulsion for use in the present invention can be used for the manufacture of multilayer light-sensitive silver halide color photographic elements, such as color negative photographic elements, color reversal photographic elements, color positive photographic elements, false color address photographic elements (such as those disclosed in U.S. Pat. No. 4,619,892) and the like, the preferred ones being color negative photographic elements.

Silver halide multilayer color photographic elements usually comprise, coated on a support, a red-sensitive silver halide emulsion layer associated with cyan dye-forming color couplers, a green-sensitive silver halide emulsion layer associated with magenta dye-forming color couplers and a blue-sensitive silver halide emulsion layer associated with yellow dye-forming color couplers. The green-sensitive layer is composed of the three green-sensitive layers described above. Each red- and blue-sensitive layer is usually comprised of multiple (two or more) emulsion sub-layers sensitive to a given region of visible spectrum. When multilayer materials contain multiple blue or red sub-layers, these can be in any case relatively faster and relatively slower sub-layers. These elements additionally comprise other non-light sensitive layers, such as intermediate layers, filter layers, antihalation layers and protective layers, thus forming a multilayer structure. These color photographic elements, after imagewise exposure to actinic radiation, are processed in a chromogenic developer to yield a visible color image. The layer units can be coated in a layer arrangement comprising the red-sensitive layers coated nearest the support and overcoated by the green-sensitive layers, a yellow filter layer and the blue-sensitive layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one nondiffusible cyan-image forming color coupler, generally a phenol or an a-naphthol compound, is associated with red-sensitive silver halide emulsion layers, at least one non-diffusible magenta image-forming color coupler, which is the 1-phenyl-3-anilino-4-phenylthio-5-pyrazolone described above, is associated with green-sensitive silver halide emulsion layers and at least one non-diffusible yellow image forming color coupler, generally an acylacetanilide compound, is associated with blue-sensitive silver halide emulsion layers.

Said color couplers may be 4-equivalent and/or 2-equivalent couplers, the latter requiring a smaller amount of silver halide for color production. As it is well known, 2-equivalent couplers derive from 4-equivalent couplers since, in the coupling position, they contain a substituent which is released during coupling reaction. 2-equivalent couplers which may be used in silver halide color photographic elements include both those substantially colorless and those which are colored ("masking couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

The most useful cyan-forming couplers are conventional phenol compounds and a-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924; in GB 1,201,110, and in Research Disclosure 308119, Section VII, 1989.

The most useful magenta-forming couplers are those described above.

The most useful yellow-forming couplers which can be used in combination with the yellow dye-forming couplers described hereinbefore are conventional open-chain ketomethylene type couplers. Particular examples of such couplers are benzoyl acetanilide type and pivaloyl acetanilide type compounds. Yellow-forming couplers that can be used are specifically described in U.S. Pat. Nos. 2,875,057, 3,235,924, 3,265,506, 3,278,658, 3,369,859, 3,408,194, 3,415,652 3,528,322, 3,551,151, 3,682,322, 3,725,072 and 3,891,445, in DE 2,219,917, 2,261,361 and 2,414,006, in GB 1,425,020, in JP 10,783/76, 26,133/72, 73,147/73, 102,636/76, 6,341/75, 123,342/75, 130,442/75, 1,827/76, 87,650/75, 82,424/77 and 115,219/77, and in Research Disclosure 308119, Section VII, 1989.

Colored couplers can be used which include those described for example in U.S. Pat. Nos. 3,476,560, 2,521,908 and 3,034,892, in JP 2,016/69, 22,335/63, 11,304/67, 32,461/69, 26,034/76 and 42,121/77 and in DE 2,418,959. The light-sensitive silver halide color photographic element may contain high molecular weight color couplers as described for example in U.S. Pat. No. 4,080,211, in EP 27,284 and in DE 1,297,417, 2,407,569, 3,148,125, 3,217,200, 3,320,079, 3,324,932, 3,331,743, and 3,340,376, and in Research Disclosure 308119, Section VII, 1989.

Colored cyan couplers can be selected from those described in U.S. Pat. Nos. 3,934,802; 3,386,301 and 2,434,272, colored magenta couplers can be selected from the colored magenta couplers described in U.S. Pat. Nos. 2,434,272; 3,476,564 and 3,476,560 and in GB 1,464,361. Colorless couplers can be selected from those described in GB 861,138; 914,145 and 1,109,963 and in U.S. Pat. No. 3,580,722 and in Research Disclosure 308119, Section VII, 1989.

Also, couplers providing diffusible colored dyes can be used together with the above mentioned couplers for improving graininess and specific examples of these couplers are magenta couplers described in U.S. Pat. No. 4,366,237 and GB 2,125,570 and yellow, magenta and cyan couplers described in EP 96,873, in DE 3,324,533 and in Research Disclosure 308119, Section VII, 1989.

Also, among the 2-equivalent couplers are those couplers which carry in the coupling position a group which is released in the color development reaction to give a certain photographic activity, e.g., as development inhibitor or accelerator, either directly or after removal of one or further groups from the group originally released. Examples of such 2-equivalent couplers include the known DIR couplers as well as DAR and FAR couplers. Typical examples of said couplers are described in DE 2,703,145, 2,855,697, 3,105,026, 3,319,428, 1,800,420, 2,015,867, 2,414,006, 2,842,063, 3,427,235, 3,209,110, and 1,547,640, in GB 953,454 and 1,591,641, in EP 89,843, 117,511, 118,087, and 301,477 and in Research Disclosure 308119, Section VII, 1989.

Examples of non-color forming DIR coupling compounds which can be used in silver halide color elements include those described in U.S. Pat. Nos. 3,938,996; 3,632,345; 3,639,417; 3,297,445 and 3,928,041; in German 2,405,442; 2,523,705; 2,460,202; 2,529,350 and 2,448,063; in Japanese 143,538/75 and 147,716/75, in GB 1,423,588 and 1,542,705 and 301,477 and in Research Disclosure 308119, Section VI, 1989.

In order to introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE 853,512 and 869,816, in U.S. Pat. Nos. 4,214,047 and 4,199,363 and in EP 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another useful method is further the Fisher process. According to such a process, couplers having a water-soluble group, such as a carboxyl group, a hydroxy group, a sulfonic group or a sulfonamido group, can be added to the photographic layer for example by dissolving them in an alkaline water solution.

Useful methods of introduction of couplers into silver halide emulsions are described in Research Disclosure 308119, Section VII, 1989.

The layers of the photographic elements can be coated on a variety of supports, such as cellulose esters supports (e.g., cellulose triacetate supports), paper supports, polyesters film supports (e.g., polyethylene terephthalate film supports or polyethylene naphthalate film supports), and the like, as described in Research Disclosure 308119, Section XVII, 1989.

The photographic elements according to this invention may be processed after exposure to form a visible image upon association of the silver halides with an alkaline aqueous medium in the presence of a developing agent contained in the medium or in the material, as known in the art. The aromatic primary amine color developing agent used in the photographic color developing composition can be any of known compounds of the class of p-phenylenediamine derivatives, widely employed in various color photographic process. Particularly useful color developing agents are the p-phenylendiamine derivatives, especially the N,N-dialkyl-p-phenylenediamine derivatives wherein the alkyl groups or the aromatic nucleus can be substituted or not substituted.

Examples of p-phenylenediamine developers include the salts of: N,N-diethyl-p-phenylenediamine, 2-amino-5-diethylamino-toluene, 4-amino-N-ethyl-N-(a-methanesulphonamidoethyl)-m-toluidine, 4-amino-3-methyl-N-ethyl-N-(a-hydroxy-ethyl)-aniline, 4-amino-3-(a-methylsulfonamidoethyl)-N,N-diethylaniline, 4-amino-N,N-diethyl-3-(N'-methyl-a-methylsulfonamido)-aniline, N-ethyl-N-methoxy-ethyl-3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-amino-N-ethyl-N-(a-methanesulfonamidoethyl)-m-toluidine sesquisulfate monohydrate (generally known as CD3 and used in the developing solution for photographic papers and color reversal materials) and 4-amino-3-methyl-N-ethyl-N-(b-hydroxyethyl)-aniline sulfate (generally known as CD4 and used in the developing solutions for color negative photographic materials).

Said color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978, and in Research Disclosure 308119, Sections XIX and XX, 1989.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt of an alkali metal or of ammonium and of trivalent iron with an organic acid, e.g., EDTA.Fe.NH4, wherein EDTA is the ethylenediamino-tetracetic acid, or PDTA.Fe.NH4, wherein PDTA is the propylenediaminotetraacetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath can contain known fixing agents, such as for example ammonium or alkali metal thiosulfates. Both bleaching and fixing baths can contain other additives, e.g., polyalkyleneoxide compounds, as described for example in GB patent 933,008 in order to increase the effectiveness of the bath, or thioether compounds known as bleach accelerators.

The present invention will be illustrated with reference to the following examples, but it should be understood that these examples do not limit the present invention.

EXAMPLE 1

A multilayer color photographic material (Sample 101) was prepared having the layers of the following compositions coated on a transparent cellulose acetate film support having a gelatin subbing layer. In the following compositions, the coating amounts of silver halide emulsions, gelatin and other additives are reported in grams per square meter (g/m$^2$). The amounts of silver halide emulsions and colloidal silver are coating weights (g/m$^2$) expressed as silver. All silver halide emulsions were stabilized with 4-hydroxy-6-methyl-1,3,3a,7-tetrazaindene and spectrally sensitized wth the appropnate spectral red, green and blue sensitizing dyes.

| Layer 1 {Antihalation Layer} | |
|---|---|
| Black colloidal silver | 0.190 |
| Gelatin | 1.280 |
| Dye 1 | 0.013 |
| Dye 2 | 0.038 |
| Magenta Masking Coupler MM-1 | 0.011 |
| Magenta Masking Coupler MM-2 | 0.010 |
| Solv-4 | 0.030 |

| Layer 2 {Interlayer} | |
|---|---|
| Gelatin | 1.100 |
| Dye 1 | 0.016 |
| Cpd-1 | 0.021 |
| UV-1 | 0.056 |
| UV-2 | 0.056 |
| Cyan Coupler C-3 | 0.018 |
| Solv-1 | 0.100 |
| Solv-4 | 0.025 |

| Layer 3 {1st (Least) Red-Sensitive Emulsion Layer} | |
|---|---|
| Silver Iodobromide Emulsion (AgI 2.5 mol %, average diameter 0.22 μm) | 0.630 |
| Gelatin | 1.230 |
| Cyan coupler C-1 | 0.302 |
| DIR Coupler D-1 | 0.018 |
| Cyan Masking Coupler CM-1 | 0.007 |
| Dye 2 | 0.010 |
| Solv-2 | 0.583 |
| Solv-3 | 0.250 |

| Layer 4 {2nd (More) Red-Sensitive Emulsion Layer} | |
|---|---|
| Silver Iodobromide Emulsion (AgI 6 mol % average diameter 0.60 μm) | 0.600 |
| Gelatin | 1.090 |
| Cyan coupler C-1 | 0.223 |
| DIR Coupler D-1 | 0.013 |
| Cyan Masking Coupler CM-1 | 0.051 |
| Solv-2 | 0.408 |
| Solv-3 | 0.175 |

| Layer 5 {3rd (Most) Red-Sensitive Emulsion Layer} | |
|---|---|
| Silver Iodobromide Emulsion (AgI 12 mol % average diameter 1.10 μm) | 0.650 |
| Gelatin | 0.960 |
| Cyan coupler C-1 | 0.085 |
| Cyan Coupler C-2 | 0.013 |
| DIR Coupler D-1 | 0.007 |
| Cyan Masking Coupler CM-1 | 0.026 |
| Solv-1 | 0.200 |
| Solv-4 | 0.200 |

| Layer 6 {Interlayer} | |
|---|---|
| Gelatin | 1.170 |
| Cpd-1 | 0.070 |
| Solv-4 | 0.110 |
| Hardener H-1 | 0.074 |

| Layer 7 {1st (Least) Green-Sensitive Layer} | |
|---|---|
| Silver Iodobromide Emulsion (AgI 2.5 mol %, average diameter 0.22 μm) | 0.510 |
| Gelatin | 0.980 |
| Magenta Coupler I-1 | 0.335 |
| DIR Coupler D-2 | 0.012 |
| Magenta Masking Coupler MM-1 | 0.015 |
| Magenta Masking Coupler MM-2 | 0.007 |
| Cpd-1 | 0.010 |
| Dye-1 | 0.060 |
| Solv-4 | 0.526 |

| Layer 8 {2nd (More) Green-Sensitive Layer} | |
|---|---|
| Silver Iodobromide Emulsion (AgI 6.0 mol %, average diameter 0.60 μm) | 0.810 |
| Gelatin | 1.190 |
| Magenta Coupler I-1 | 0.100 |
| DIR Coupler D-2 | 0.020 |
| Magenta Masking Coupler MM-1 | 0.041 |
| Magenta Masking Coupler MM-2 | 0.020 |
| Cpd-1 | 0.015 |
| Solv-4 | 0.200 |

| Layer 9 {3rd (Most) Green-Sensitive Layer} | |
|---|---|
| Silver Iodobromide Emulsion (AgI 12.0 mol %, average diameter 1.10 μm) | 0.960 |
| Gelatin | 1.630 |
| Magenta Coupler M-2 | 0.160 |
| DIR Coupler D-2 | 0.002 |
| Magenta Masking Coupler MM-1 | 0.040 |
| Magenta Masking Coupler MM-2 | 0.021 |
| Cpd-1 | 0.015 |
| Solv-4 | 0.300 |

| Layer 10 {interlayer} | |
|---|---|
| Gelatin | 1.090 |

-continued

| Layer 11 {Yellow Filter Layer} | |
|---|---|
| Yellow Colloidal Silver | 0.056 |
| Gelatin | 1.040 |
| Hardener H-1 | 0.065 |

| Layer 12 {1st (Less) Blue-Sensitive Layer} | |
|---|---|
| Silver Iodobromide Emulsion (AgI 2.5 mol %, average diameter 0.22 μm) | 0.230 |
| Silver Iodobromide Emulsion (AgI 6.0 mol %, average diameter 0.60 μm) | 0.281 |
| Gelatin | 1.070 |
| Yellow Coupler Y-1 | 0.869 |
| DIR Coupler D-3 | 0.046 |
| Solv-5 | 0.288 |
| Solv-1 | 0.288 |

| Layer 13 {2nd (More) Blue-Sensitive Layer} | |
|---|---|
| Silver Iodobromide Emulsion (AgI 12 mol %, average diameter 1.10 μm) | 0.480 |
| Gelatin | 1.110 |
| Yellow Coupler Y-1 | 0.286 |
| DIR Coupler D-3 | 0.029 |
| Cyan Coupler C-2 | 0.072 |
| Solv-5 | 0.088 |
| Solv-1 | 0.088 |

| Layer 14 {First Protective Layer} | |
|---|---|
| Unsensitized Silver Bromide Lippmann Emulsion | 0.210 |
| Gelatin | 1.150 |
| UV-1 | 0.098 |
| UV-2 | 0.098 |
| Cpd-2 | 0.134 |

| Layer 15 {Second Protective Layer} | |
|---|---|
| Gelatin | 1.020 |
| Matte Polymethylmethacrylate Beads | 0.014 |
| Matte Copoly(ethylmethacrylate-methacrylic acid) Beads | 0.179 |
| Hardener H-2 | 0.356 |

Multilayer color photographic material (Sample 102) was prepared in the same manner as Sample 101, but replacing in the layer 9 (3rd most green-sensitive emulsion layer) the magenta dye-forming 4-equivalent coupler M-2 with 0.103 g /$m^2$ of the same magenta dye-forming 2-equivalent coupler I-1 of layers 7 and 8, and increasing the amount of DIR Coupler D-2 to 0.008 g/$m^2$.

Multilayer color photographic material (Sample 103) was prepared in the same manner as Sample 101, but replacing in the layer 9 (3rd most green-sensitive emulsion layer) the magenta dye-forming 4-equivalent coupler M-2 with 0.207 g /$m^2$ of the same magenta dye-forming 2-equivalent coupler I-1 of layers 7 and 8, and increasing the amount of DIR Coupler D-2 to 0.015 $gIm^2$.

The following Table 1 reports the constitution of layers 8 and 9 of Samples 101–103. The ratios Coupler/Ag and DIRC/Ag are weight ratios.

TABLE 1

| | Layer 8 | | | Layer 9 | | |
|---|---|---|---|---|---|---|
| Sample | Coupler | Coupler/Ag | DIRC/Ag | Coupler | Coupler/Ag | DIRC/Ag |
| 101 (comp.) | I-1 | 0.123 | 0.025 | M-2 | 0.166 | 0.0021 |
| 102 (comp.) | I-1 | 0.123 | 0.025 | I-1 | 0.107 | 0.0083 |
| 103 (inv.) | I-1 | 0.123 | 0.025 | I-1 | 0.216 | 0.0156 |

Samples 101–103 were individually exposed to white light of a color temperature of 5500 K and then processed in accordance with the Kodak C-41 color negative process (as described in British Journal of Photography Annual, pp. 196–198, 1988). Excellent and comparable results in sensitometric properties (maximum density, minimum density, speed and contrast) were obtained with all the samples. Granularity resulted good for samples 101 and 103 and bad for sample 102. Total maximum color density of the three green-sensitive silver halide emulsion layers and maximum density of each single layer resulted as reported in Table 2.

TABLE 2

| | Maximum Color Density | | | |
|---|---|---|---|---|
| Sample | Total | Layer 7 | Layer 8 | Layer 9 |
| 101 (comp.) | 2.34 | 1.32 | 0.39 | 0.63 |
| 102 (comp.) | 2.35 | 1.46 | 0.44 | 0.45 |
| 103 (inv.) | 2.38 | 1.24 | 0.37 | 0.77 |

A second set of Samples 101–103 was subjected to a formaldehyde resistivity test as follows. Film strips having a width of 35 mm of each sample were tightly wound on a core and then exposed in dark conditions to formaldehyde vapors obtained by putting on the base of a closed vessel 0.42 weight percent of formaldehyde in water to give a 90 percent of relative humidity in the vessel. After 10 days at room temperature, the films were unwound, uniformly exposed to white light, processed in accordance with the Kodak C-41 color negative process and printed on Kodak Royal color paper. Prints of Sample 101, having the 2-equivalent magenta coupler I-1 in green-sensitive layers 7 and 8 and the 4-equivalent magenta coupler M-2 in green-sensitive layer 9, presented a severe magenta coloration on the lateral edges. Prints of Samples 102 and 103, having the 2-equivalent magenta coupler I-1 in green-sensitive layers 7, 8 and 9, were exempt from magenta coloration on the lateral edges.

Interimage effects were calculated as follows. Samples of each film were exposed to a light source having a color temperature of 5500 K though a Kodak Wratten™ W99 filter and an optical step wedge (selective exposure of the green sensitive layers) or through a Kodak Wratten™ W29 filter and an optical step wedge (selective exposure of the red sensitive layers). Other samples of each film were exposed as above but without any filter (white light exposure). All the exposed samples were developed as described above. Contrasts of the obtained sensitometric curve for selective exposures (gammas) and white light exposure (gammaw) were measured for each film in the low dye-density or toe region (Beta 1) and the high dye-density or shoulder region (Beta 2). Interimage effects (IIE) are measured as follows:

$$IIE = \frac{gamma_s - gamma_w}{gamma_w} \times 100$$

wherein the higher the numbers, the better the interimage effects. The results obtained are reported in Table 3.

TABLE 3

| | Interimage Effects | | | |
|---|---|---|---|---|
| | Toe Contrast | | Average Contrast | |
| Sample | Magenta | Yellow | Magenta | Yellow |
| 101 (comp.) | 34.0 | 15.4 | 10.9 | 2.6 |
| 102 (comp.) | 28.8 | 25.4 | 8.9 | 7.0 |
| 103 (inv.) | 32.7 | 30.4 | 13.8 | 10.1 |

Formulas for the compounds used in the Examples are as follows

Dye 1:

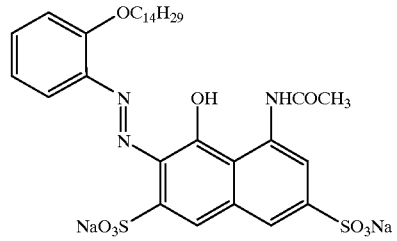

Dye 2:

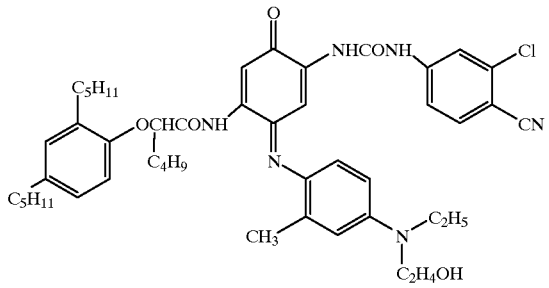

Cpd-1:
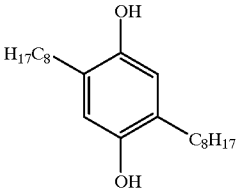
UV-1:
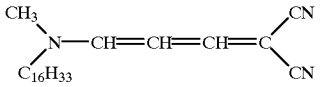
UV-2
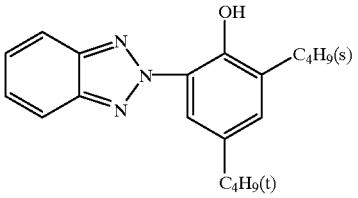
Cyan Coupler C-1:
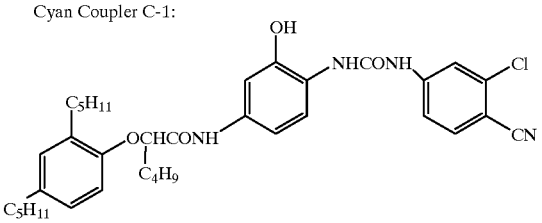
Cyan Coupler C-2:
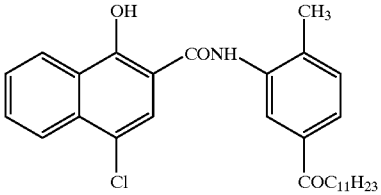
Cyan Coupler C-3:
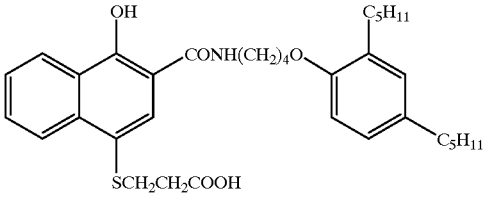
Cyan Masking Coupler CM-1:
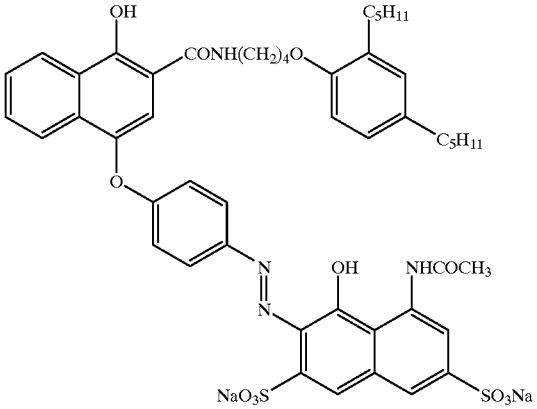
DIR Coupler D-1:
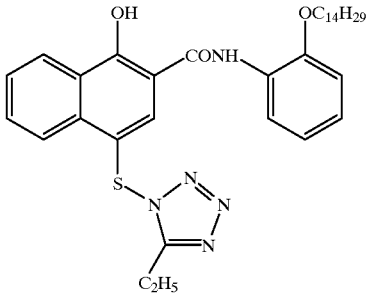
Solv-1: N-Butylacetanilide
Solv-2: Triphenyl Phosphate
Solv-3: Dibutylphthalate
Solv-4: Tricresyl Phosphate
Solv-5: Bis-(2-ethylhexyl)-phthalate
Hardener H-1:
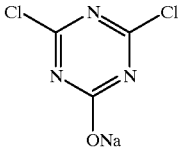
Magenta Coupler I-1:
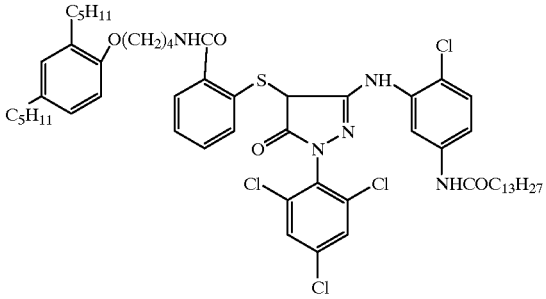

Magenta Coupler M-2:
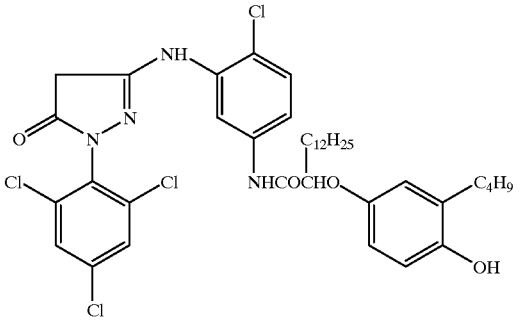
DIR Coupler D-2:
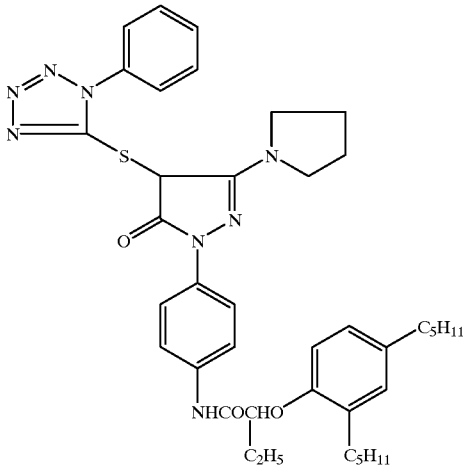
Magenta Masking Coupler MM-1:
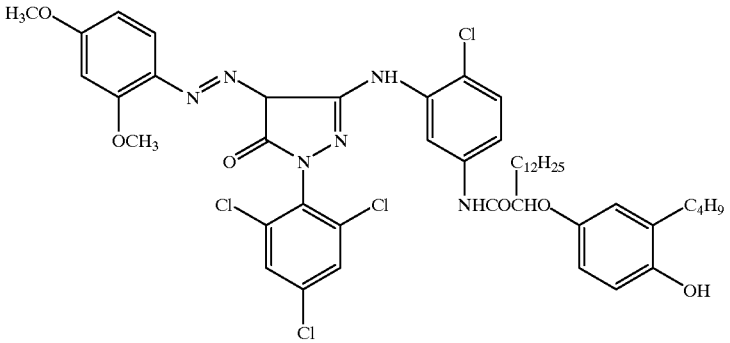

Magenta Masking Coupler MM-2:

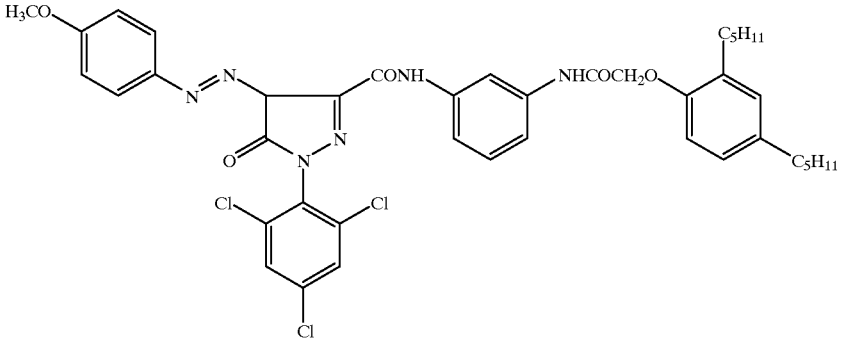

Yellow Coupler Y-1:

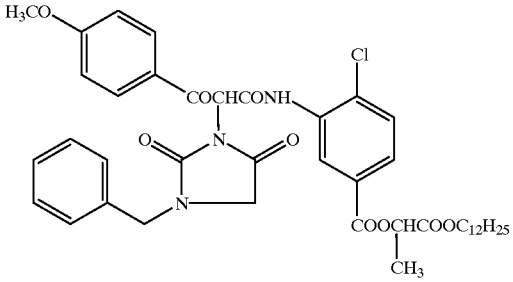

DIR Coupler D-3:

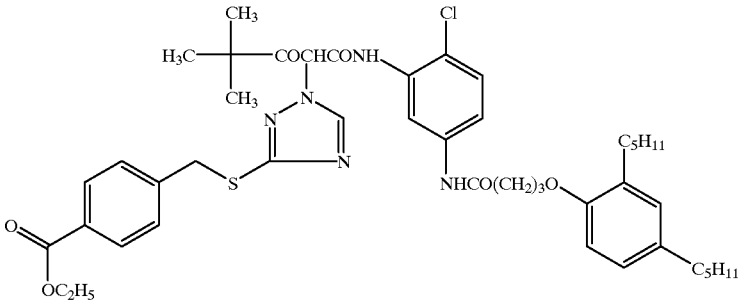

Cpd-2:

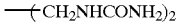

Hardener H-2:

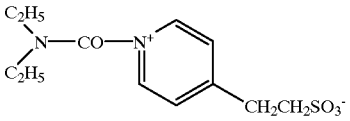

EXAMPLE 2

A multilayer color photographic material (Sample 201) was prepared similar to Sample 101 of Example 1. Multilayer color photographic materials (Samples 202–208) were prepared similar to Sample 103 of Example 1, but containing in layer 9 the constitution reported in Table 4.

TABLE 4

| | Layer 9 | | |
|---|---|---|---|
| Sample | Coupler | Coupler/Ag | DIRC/Ag |
| 201 (comp.) | M-2 | 0.166 | 0.0021 |
| 202 (inv.) | I-1 | 0.140 | 0.0083 |
| 203 (inv.) | I-1 | 0.140 | 0.0107 |
| 204 (inv.) | I-1 | 0.180 | 0.0107 |
| 205 (inv.) | I-1 | 0.180 | 0.0130 |
| 206 (inv.) | I-1 | 0.210 | 0.0107 |
| 207 (inv.) | I-1 | 0.210 | 0.0131 |
| 208 (inv.) | I-1 | 0.210 | 0.0153 |

The following Table 5 reports the values of interimage effects for the magenta unit of each sample measured as described in Example 1.

TABLE 5

| Sample | Interimage Effects | |
|---|---|---|
| | Toe Contrast | Average Contrast |
| 201 (comp.) | 33.3 | 15.0 |
| 202 (inv.) | 48.1 | 23.3 |
| 203 (inv.) | 40.7 | 20.0 |
| 204 (inv.) | 53.7 | 28.3 |
| 205 (inv.) | 44.4 | 25.0 |
| 206 (inv.) | 53.7 | 33.3 |
| 207 (inv.) | 59.3 | 31.7 |
| 208 (inv.) | 48.1 | 25.0 |

What is claimed is:

1. A light-sensitive silver halide multilayer color photographic element having on a support base blue-, green- and red-sensitive silver halide emulsion layers respectively associated with non-diffusing yellow, magenta and cyan dye-forming couplers, wherein (a) the green-sensitive silver halide emulsion layer comprises three green-sensitive silver halide emulsion layers, respectively uppermost, intermediate and lowermost, sensitive to the same spectral region of visible light, in which the sensitivity of the three green-sensitive silver halide emulsion layers decreases in order from the uppermost silver halide emulsion layer to the lowermost silver halide emulsion layer, (b) each of the three green-sensitive silver halide emulsion layers contains a 2-equivalent 1-phenyl-3-anilino-4-phenylthio-5-pyrazolone magenta dye-forming coupler, (c) the weight ratio of said coupler to silver halide (expressed as silver) in the highest sensitivity uppermost green-sensitive silver halide emulsion layer is higher than the weight ratio of said coupler to silver halide (expressed as silver) in the medium sensitivity intermediate green-sensitive silver halide emulsion layer, and (d) the highest sensitivity uppermost green-sensitive silver halide emulsion layer contains a DIR coupler.

2. The multilayer photographic element of claim 1, wherein said 2-equivalent 1-phenyl-3-anilino-4-phenylthio-5-pyrazolone magenta dye-forming coupler is represented by the formula:

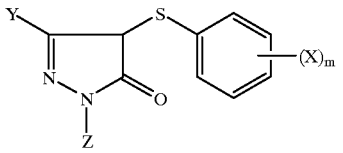

wherein Z represents a phenyl group substituted with one or more substituents selected from halogen atoms, alkyl groups, alkoxy groups, alkoxycarbonyl groups, or cyano groups, Y represents an anilino group, X represents hydrogen, alkyl, alkoxy, halogen, aryl, aryloxy, acylamino, sulfonamido, sulfamoyl, carbamoyl, arylsulfonyl, aryloxycarbonyl, alkoxycarbonyl, alkoxysulfonyl, aryloxysulfonyl, alkylureido, arylureido, nitro, cyano, hydroxyl or carboxy group, m represents an integer of from 1 to 5 and X may be the same or different when m is 2 or more.

3. The multilayer photographic element of claim 1, wherein said 2-equivalent 1-phenyl-3-anilino-4-phenylthio-5-pyrazolone magenta dye-forming coupler is represented by the formula:

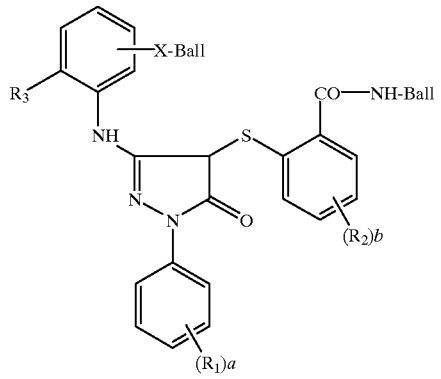

wherein a represents an integer from 0 to 3, b represents an integer from 0 to 2, $R_1$ and $R_2$ are each individually hydrogen, alkyl, alkoxy, halogen, aryl, aryloxy, acylamino, sulfonamido, sulfamoyl, carbamoyl, arylsulfonyl, aryloxycarbonyl, alkoxycarbonyl, alkoxysulfonyl, aryloxysulfonyl, alkylureido, arylureido, nitro, cyano, hydroxyl or carboxy group, $R_3$ is halogen atom, alkyl group or aryl group, X is a direct link or a linking group, Ball is a ballasting group of such size and configuration as to render a group to which is attached non-diffusible in photographic coatings, and the sum of the sigma values of $R_1$, $R_3$ and X-Ball is less than 1.3.

4. The multilayer photographic element of claim 3, wherein Ball comprises a hydrophobic group of at least 8 carbon atoms.

5. The multilayer photographic element of claim 3, wherein X is an imino, ether, carbonamido, sulfonamido, ureido, imido, carbamoyl or sulfamoyl group.

6. The multilayer photographic element of claim 3, wherein $R_3$ is chlorine.

7. The multilayer photographic element of claim 3, wherein $R_1$ is chlorine, a represents 3 and chlorine atoms are in the positions 2, 4 and 6 to the carbon atom attached to the nitrogen atom.

8. The multilayer photographic element of claim 3, wherein X is a carbonamido group.

9. The multilayer photographic element of claim 1, wherein the weight ratio of said coupler to silver halide (expressed as silver) in the highest sensitivity uppermost green-sensitive silver halide emulsion layer is 10 to 150% higher than the weight ratio of said coupler to silver halide (expressed as silver) in the medium sensitivity intermediate green-sensitive silver halide emulsion layer.

10. The multilayer photographic element of claim 1, wherein the maximum color density, after development, in the highest sensitivity uppermost green-sensitive silver halide emulsion layer is higher than the maximum color density, after development, in the medium sensitivity intermediate green-sensitive silver halide emulsion layer.

11. The multilayer photographic element of claim 10, wherein the maximum color density, after development, in the highest sensitivity uppermost green-sensitive silver halide emulsion layer is higher than 0.6, and the maximum color density, after development, in the medium sensitivity intermediate green-sensitive silver halide emulsion layer is lower than 0.6.

12. The multilayer photographic element of claim 1, wherein said DIR coupler is represented by the formula COUP-Z wherein Z represents a releasable development inhibitor group and COUP represents a coupler moiety capable of releasing the Z group and forming a dye through coupling with the oxidized product of a color developing agent.

13. The multilayer photographic element of claim 1, wherein said DIR coupler is represented by the formula

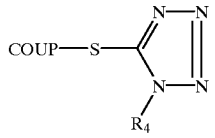

wherein COUP represents a coupler moiety and $R_4$ represents an alkyl group or a phenyl group.

14. The multilayer photographic element of claim 1, wherein said DIR coupler is present in the highest sensitivity uppermost green-sensitive silver halide emulsion layer in an amount of 2 to 10% by weight based on the amount of the 2-equivalent 1-phenyl-3-anilino-4-phenylthio-5-pyrazolone magenta dye-forming coupler.

* * * * *

UNITED STATES PATENT AND TRADEMARK OFFICE

CERTIFICATE OF CORRECTION

PATENT NO. : 6,020,115
DATED : June 23, 1998
INVENTOR(S) : Ferdinando Orengo, Luisa Tavella and Antonio Poggi It is certified that error appears in the above-identified patent and that said Letters Patent is hereby corrected as shown below:

Title page,
Item [73], Assignee, please add "S.A." after the Assignee's name:
Tulalip Consultoria Comercial Sociedade Unipessoal S.A.

Signed and Sealed this

Seventh Day of May, 2002

*Attest:*

*Attesting Officer*

JAMES E. ROGAN
*Director of the United States Patent and Trademark Office*